US005376029A

United States Patent [19]

Entringer et al.

[11] Patent Number: 5,376,029

[45] Date of Patent: Dec. 27, 1994

[54] CONTROL VALVE

[75] Inventors: David C. Entringer, Wautoma, Wis.; Gary R. Polson, Stillwater, Okla.

[73] Assignee: Brunswick Corporation, Skokie, Ill.

[21] Appl. No.: 36,816

[22] Filed: Mar. 25, 1993

[51] Int. Cl.[5] ..... B63H 5/12

[52] U.S. Cl. ..... 440/61; 114/144 R; 137/625.069; 137/596.013

[58] Field of Search ..... 137/625.69, 596.13; 114/144 R, 150, 171; 440/53, 61

[56] References Cited

U.S. PATENT DOCUMENTS

| | | | |
|---|---|---|---|
| 3,581,771 | 6/1971 | Garrison | 137/625.69 |
| 3,768,376 | 10/1973 | Orme | 137/625.69 |
| 4,337,796 | 7/1982 | Bonney | 137/625.69 |
| 4,595,370 | 6/1986 | Small | 440/61 |

*Primary Examiner*—Edwin L. Swinehart

*Attorney, Agent, or Firm*—Andrus, Sceales, Starke & Sawall

[57] ABSTRACT

A control valve for a pressurized fluid-operated system, such as a marine power steering system, includes a housing having an inlet and at least one outlet, with one or more work ports located therebetween. Pressurized fluid is supplied to the inlet, and a spool member is mounted within the housing for controlling the supply of pressurized fluid to a work-performing system, such as the extendible and retractable rod of a hydraulic cylinder assembly. The spool member includes structure for blocking the one or more work ports when the spool member is in its neutral position, when it is desired not to operate the system. This prevents the cylinder from being exposed to reservoir fluid when the spool member is in its neutral position.

10 Claims, 2 Drawing Sheets

CONTROL VALVE

BACKGROUND AND SUMMARY

This invention pertains to a control valve for a pressurized fluid-operated system, such as a marine power steering system in which a hydraulic cylinder assembly, including an extendible and retractable rod, provides a steering assist to a pivotable marine drive unit.

A marine power steering system typically includes a hydraulic cylinder assembly having an extendible and retractable rod, and a control valve for controlling the supply and discharge of fluid to and from the cylinder, to control extension and retraction of the cylinder rod. The control valve includes a housing having an internal passage, and a spool member mounted within the internal passage. The housing includes work ports which communicate with opposite ends of the cylinder, and the spool member is provided with grooves for routing fluid to one end or the other of the cylinder upon movement of the spool member within the passage.

The control valve is an open center design in which fluid from the pump is returned to the reservoir when the spool valve is in its neutral position, i.e. when no steering assist is required. In the past, when the spool valve is in its neutral position, the work ports are exposed to the reservoir as fluid from the pump flows from the inlet to the outlet of the housing. Both ends of the cylinder are thus exposed to the reservoir when the spool member is in its neutral position. With this design, it is possible for the power steering system to experience drift as a result of propeller torque or other factors, with the result being that the marine drive unit may move away from its desired position even though no steering impetus is applied to the spool member. The external load on the hydraulic cylinder rod begins to create pressure in one end of the cylinder, but since both ends are connected to the reservoir the fluid is allowed to exit one end of the cylinder and enter the other, thus causing the cylinder to drift from its desired position.

It is an object of the present invention to provide a valve for controlling the flow of fluid in a fluid-operated system, such as a marine power steering system, for preventing the work ports from being exposed to the reservoir when the spool member is in its neutral position while also being used in a following or servo positioning mode. It is a further object of the invention to provide such a valve which is simple in its construction and operation, yet which provides highly advantageous operation of the fluid-operated system.

In accordance with one aspect of the inventions a control valve for a pressurized fluid-operated system, such as a marine power steering system, includes a spool member mounted for sliding movement within the housing internal passage, with the spool member being movable between a neutral position and at least a first working position. The spool member includes structure which cooperates with the housing internal passage for establishing communication between the housing inlet and the work port when the spool member is in its first working position. The spool member structure further establishes communication between the inlet and the outlet when the spool member is in its neutral position, while blocking the work port when the spool member is in its neutral position. In this manner, the work port is not exposed to reservoir fluid when the spool member is in its neutral position, and the resulting detrimental effects such as drift of the marine propulsion unit are prevented. The spool member includes a recess arrangement which functions to establish communication between the inlet and the outlet when the spool member is in its neutral position. A protrusion, such as in the form of a land, is provided on the spool member and is located over the work port when the spool member is in its neutral position. The land blocks entry of fluid into the work port in the neutral position. In a preferred form, the recess arrangement includes a pair of annular grooves, one of which is in communication with the inlet and the other of which is in communication with the outlet. A channel extends between the grooves to establish communication therebetween. The annular grooves and the channel cooperate to define the land, which functions to block the work port when the spool member is in its neutral position.

The invention may advantageously be incorporated into a marine power steering system, which includes a pair of work ports, each of which is located between the inlet and one of a pair of outlets. Structure as summarized in the preceding paragraph is provided on the spool member for each of the work ports.

The invention further contemplates a method of controlling the flow of fluid in a pressurized fluid-operated system, such as a marine power steering system. The method broadly comprises the steps of establishing communication between the pressurized fluid source and the work port when it is desired to operate the system, and blocking communication between the pressurized fluid source and the work port while establishing communication between the pressurized fluid source and the outlet, to provide return flow of fluid from the system to the reservoir, when it is desired not to operate the system. The specifics of the method of the invention are generally according to the above-summarized aspects of the apparatus of the invention.

Various other features, objects and advantages of the invention will be made apparent from the following description taken-together with the drawings.

BRIEF DESCRIPTION OF THE DRAWINGS

This drawings illustrate the best mode presently contemplated of carrying out the invention.

In the drawings.

DETAILED DESCRIPTION OF THE PRIOR ART

Figure 1:
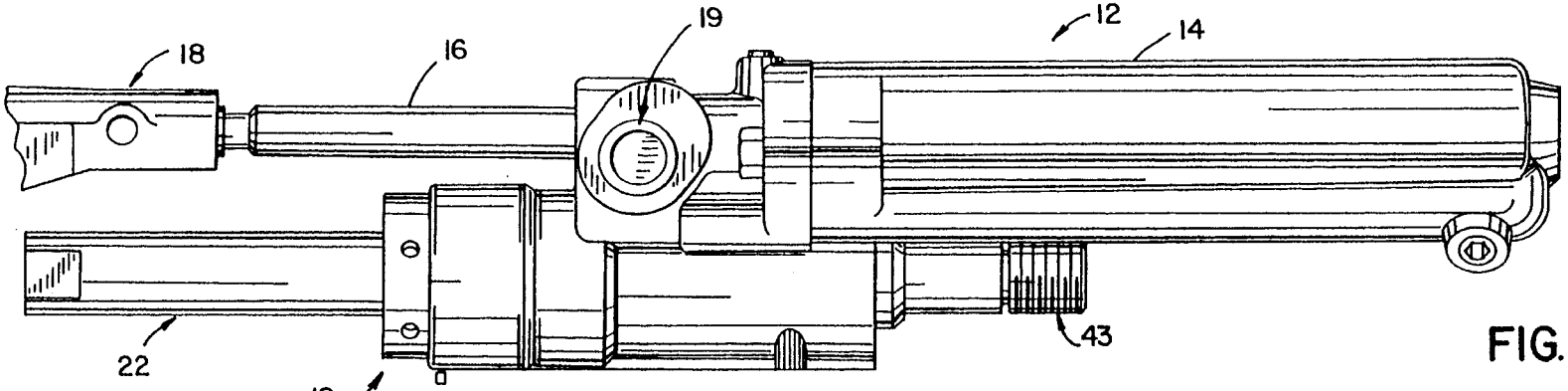
FIG. 1 is a partial elevation view showing the assembled components of a marine power steering system into which the invention is incorporated.

FIG. 1 illustrates a marine power steering system, such as for use in an inboard/outboard stern drive system, consisting generally of a control valve assembly 10, a cylinder assembly 12 having a barrel 14 and an extendible and retractable rod 16 connected to a piston 17, and a linkage 18 mounted to the end of rod 16. In a manner as is known, linkage 18 is connected to a marine propulsion unit pivotably mounted to the transom of a boat, for providing pivoting movement about pivoting bushings 19 of the marine drive unit and thereby steering of the boat.

Figure 2:
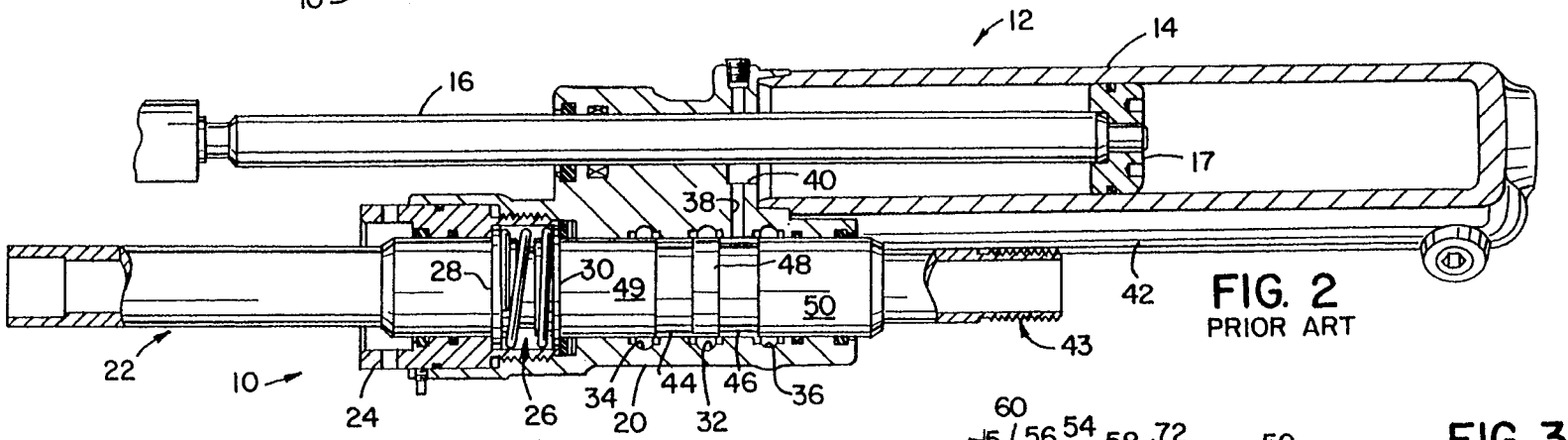
FIG. 2 PRIOR ART
FIG. 2 is a sectional view of the marine power steering system of FIG. 1, showing a prior art spool member mounted within the internal passage of the control valve housing.

As shown in FIGS. 1 and 2, control valve 10 includes a housing 20 which defines an annular passageway therethrough extending along a longitudinal axis, and a spool member 22 which includes flow-controlling structure located within the housing internal passage. Spool member 22 is mounted to housing 10 by a mounting member 24 having a threaded end engageable with a series of internal threads provided on housing 20. A spring 26 is located between a pair of split rings 28, 30 mounted to spool member 22 for providing a spring return of spool member 22 to its neutral position, as shown in FIG. 2, within the internal passage of housing 20.

Housing 20 includes an annular inlet recess 32, and a pair of outlet recesses 34, 36 located one on either side of inlet recess 32. Pressurized fluid is supplied to inlet recess 32 from a source of pressurized fluid, such as a pump, to which fluid is supplied from a reservoir. Outlet recesses 34, 36 are in communication with the reservoir, for returning fluid thereto from housing 20.

A work passage 38 is formed in housing 20, and defines a work port in communication with the internal passage of housing 20. Passage 38 communicates with the interior of barrel 14 through a recess 40. With this arrangement, pressurized fluid can be supplied to the rod side of cylinder assembly 12, to move piston 17 rightwardly within barrel 14 to thereby retract rod 16. As shown in FIG. 2 passage 38, and its associated work port, is located between inlet recess 32 and outlet recess 36.

In a similar manner, a second work passage (not shown in FIG. 2) defines a work port located between inlet recess 32 and outlet recess 34, for supplying pressurized fluid to an internal passage formed in an axially extending protrusion 42 associated with barrel 14, to supply pressurized fluid to the piston end of barrel 14 to move piston 17 leftwardly, to thereby extend rod 16.

Spool member 22 is interconnected with a steering cable (not shown) interconnected with an operator-controlled steering wheel, for providing a steering input thereto. The cable sheath is connected to the end of spool member 22, shown at 43, while the cable goes through hollow spool 22 and is connected to linkage 18. This allows the operator to steer manually in the event the fluid pump fails to supply pressure.

The portion of spool member 22 located within the internal passage of housing 20 defines a pair of grooves 44, 46, with a land 48 disposed therebetween. Spool member 22 further defines a land 49 extending leftwardly from groove 44, and a land 50 extending rightwardly from groove 46.

With spool member 22 in its neutral position, land 48 is positioned midway in inlet recess 32. Groove 44 establishes communication between inlet recess 32 and outlet recess 34, and groove 46 establishes communication between inlet recess 32 and outlet recess 36. The work ports, which supply pressurized fluid to piston 17 such as through work passage 38 and the internal work passage formed in protrusion 42, are blocked when spool member 22 is in its neutral position. This provides an open center design, in which pressurized fluid supplied to inlet recess 32 is communicated directly to outlet recesses 34, 36, with piston 17 being held in position.

When it is desired to extend rod 16 to steer the boat in one direction, spool member 22 is shifted rightwardly within housing 20 in response to an operator's movement of the steering wheel to extend the steering cable. The cable passes through spool 22 and begins to push on the sheath connected to spool end 43. This moves spool 22 to the right. Such rightward movement of spool member 22 results in land 49 cutting off communication between inlet passage 32 and outlet passage 34, and also results in land 48 cutting off communication between inlet recess 32 and the work port of passage 38. Communication between the work port of passage 38 and outlet recess 36 is established through groove 46. Pressurized fluid is thus supplied from inlet recess 32 to the internal passage within protrusion 42, and to the rightward face of piston 17 to move piston 17 leftwardly within barrel 14. Fluid from the opposite end of barrel 14 is expelled therefrom through recess 40 and passage 38, and is supplied to outlet recess 36 through groove 46 and returned to the reservoir.

In a similar manner, to retract rod 16 to steer the boat in the opposite direction, spool member 22 is shifted leftwardly within housing 20. Land 48 cuts off communication between inlet recess 32 and outlet recess 34, and land 50 cuts off communication between work passage 38 and outlet recess 36 while groove 46 establishes communication between inlet recess 32 and work passage 38. Pressurized fluid is supplied from inlet recess 32 through groove 46 to the work port of passage 38, and thereby through recess 40 to the leftward face of piston 17. Piston 17 is thus moved rightwardly, and fluid in the rightward end of barrel 14 is expelled through the internal passage of protrusion 42 to the work port disposed between inlet recess 32 and outlet recess 34, and through groove 44 and outlet recess 34 for return to the reservoir.

DETAILED DESCRIPTION OF THE INVENTION

Figure 3:
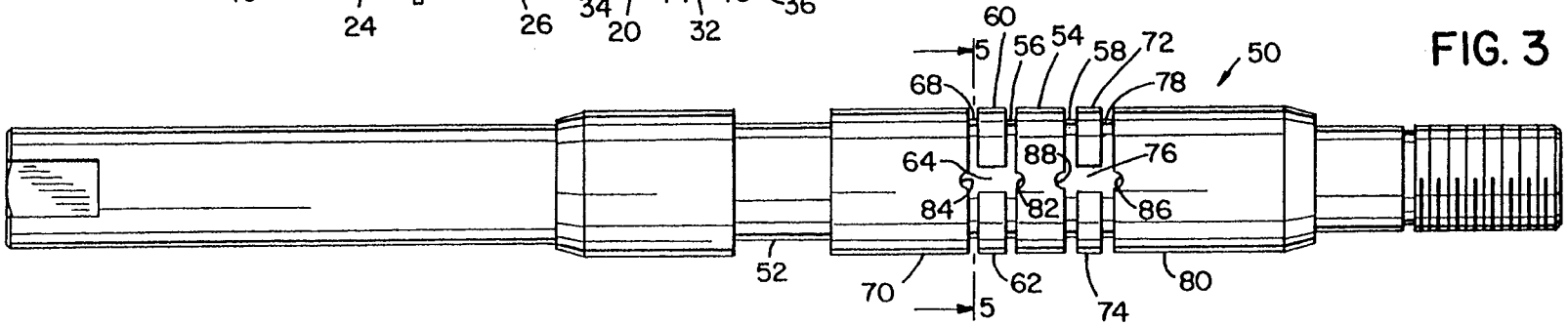
FIG. 3 is an elevation view of a spool member constructed according to the invention, for use in the marine power steering system of FIGS. 1 and 2.

FIG. 3 illustrates a spool member 50 constructed according to the invention, adapted to be used in connection with housing 20 and cylinder assembly 12 as a replacement for spool member 22. Accordingly, like reference characters will be used where possible in FIGS. 3-6 to facilitate clarity in the description of housing 20 and cylinder assembly 12.

Figure 4:
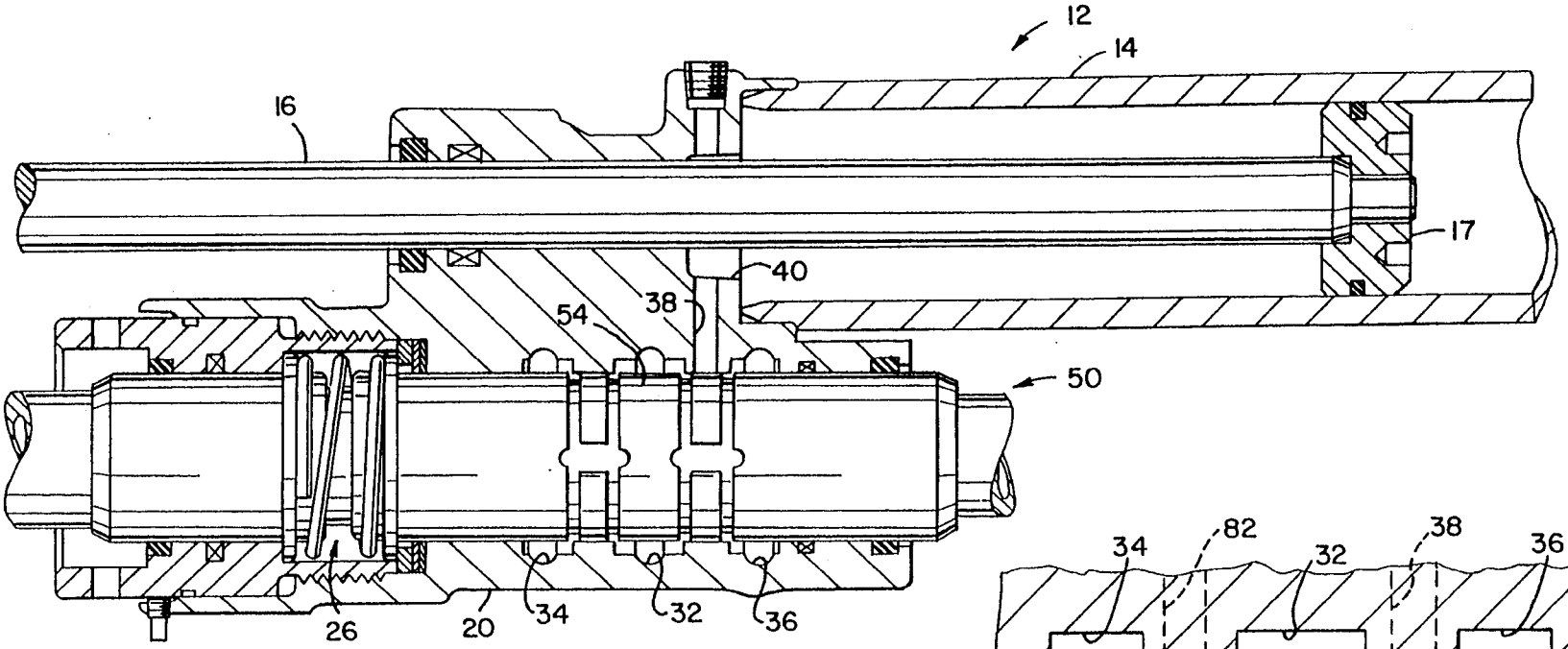
FIG. 4 is a partial elevation view showing the spool member of FIG. 3 incorporated into the marine power steering system.

Spool member 50 includes a groove 52 which is adapted to receive spring assembly 26, as shown in FIG. 4, in the same manner as shown in FIG. 2 with respect to spool member 22.

Referring to FIG. 3, spool member 50 further includes a central land 54, which corresponds in function and location with land 48 of spool member 22. Annular grooves 56, 58 are formed one on either side of land 54. A pair of arcuate lands 60, 62 are located adjacent groove 56, and a pair of channels 64, 66 (FIGS. 3, 5) separate the ends of arcuate lands 60, 62. An annular groove 68 separates arcuate lands 60, 62 and an end land 70.

In a similar manner, a pair of arcuate lands 72, 74 are located adjacent groove 58 on the other side of central land 54, with a pair of channels, such as shown at 76, separating lands 72, 74. An annular groove 78 is located between arcuate lands 72, 74 and an end land 80.

Figure 5:
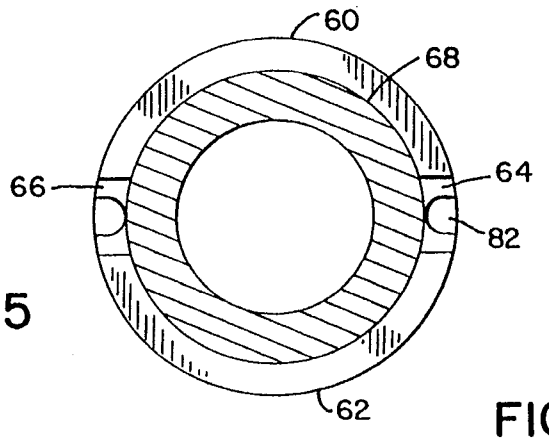
FIG. 5 is a section view taken generally along line 5—5 of FIG. 3.

Referring to FIGS. 3 and 5, a semicircular trough 82 is formed in the leftward side of central land 54 in alignment with channel 64, and a similar trough 84 is formed in the leftward side of end land 70. Likewise, a semicircular trough 86 is formed in the leftward side of end land 80, in alignment with channel 76 and a similar trough 88 formed in the rightward side of central land 54. Similar troughs, such as those shown at 82–86, are formed in lands 54, 70, and 80 on the opposite side of spool member 51, in alignment with the channels between arcuate lands 60, 62 and 72, 74.

FIG. 4 illustrates spool member 50 in place within control valve housing 20, for controlling the supply of fluid to and from barrel 14 of cylinder assembly 12. Spool member 51 controls supply of fluid to and from cylinder assembly 12 in a manner similar to that of prior art spool member 22.

Figure 6:
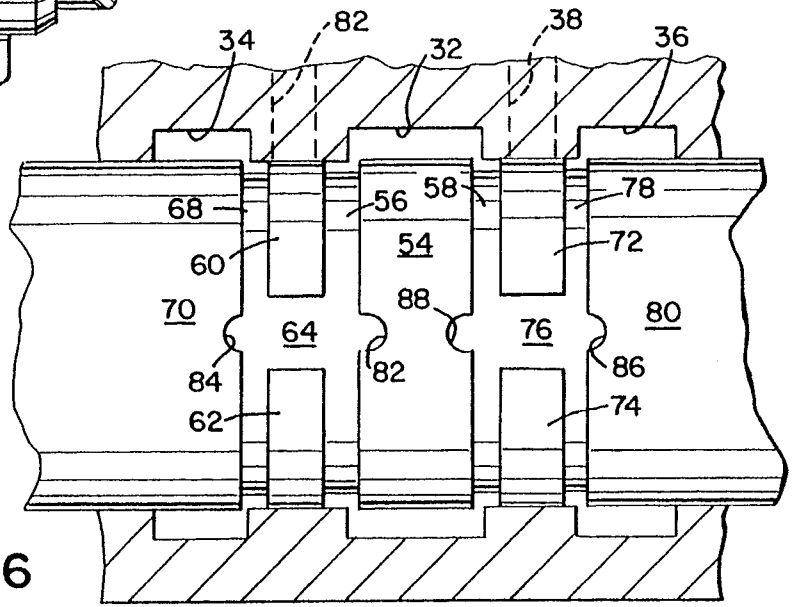
FIG. 6 is an enlarged partial section view of a portion of the marine power steering system and spool member of FIG. 4.

Referring to FIGS. 4 and 6, spool member 50 is shown in its neutral position. In this position, spool member central land 54 is positioned midway in inlet recess 32. Left end land 70 is positioned in outlet recess 34, and right end land 80 is positioned in outlet recess 36. Central land 54 has a width less than that of inlet recess 32, and end lands 70, 80 terminate inwardly of the end walls of outlet recesses 34, 36. With this construction, pressurized fluid supplied to inlet recess 32 from the pump, with spool member 50 in its neutral position, passes from inlet recess 32 to outlet recess 34 through groove 56, channels 64, 66 and groove 68. In a similar manner, fluid passes to outlet recess 36 through grooves 58 and 78, and the channels therebetween, such as shown at 76.

Arcuate lands 60, 62, 72 and 74 function to block the work ports through which pressurized fluid is supplied to piston 17. In FIG. 6, the work passages for supplying pressurized fluid to piston 17 are shown at 38 and 82. Land 72 functions to block the work port defined by passage 38, while land 60 functions to block the work port defined by passage 82. In this manner, piston 17 is not exposed to reservoir fluid when spool member 50 is in its neutral position, thus eliminating drift in the steering system.

Troughs 82, 84 and 86, 88 act as a cushion to pressure surges when spool member 50 is moved by allowing a more gradual opening and closing action. Absent troughs 82, 84 and 86, 88, the relatively large diameter of spool member 50 would create large changes in area open to fluid flow.

When it is desired to extend rod 16 of cylinder assembly 12, spool member 50 is shifted rightwardly within housing 20 in response to operator steering, as in the prior art. End land 70 cuts off outlet recess 34, and the work port of passage 82 is exposed through groove 68, channels 64, 66 and groove 56 to inlet recess 32. Land 54 cuts off communication between inlet recess 32 and the work port of passage 38. At the same time, communication is established between outlet recess 36 and the work port of passage 38 through grooves 58. 78 and the channels therebetween, such as shown at 76. In the same manner as described previously, supply of pressurized fluid from inlet recess 32 to work passage 82 results in pressurized fluid being supplied to the rightward end of barrel 14 to extend rod 16, with fluid expelled from the leftward end of barrel 14 being routed through work passage 38, grooves 58, 78 and the channels therebetween, such as 76, to outlet recess 36.

To retract rod 16, spool member 50 is shifted leftwardly in response to operator steering. End land 80 cuts off outlet recess 36, and communication is established between the work port of passage 38 and inlet recess 32 through grooves 58, 78 and the channels therebetween, such as shown at 76. Central land 54 cuts off communication between inlet recess 32 and outlet recess 34, and communication is established between passage 82 and outlet recess 34 by grooves 56, 68 and channels 64, 66. Pressurized fluid is thus supplied from inlet recess 32 to passage 38, for moving piston 17 rightwardly. Expelled fluid from the rightward end of barrel 14 is routed through passage 82 to outlet recess 34 through grooves 56, 68 and channels 64, 66.

While the invention has been described with particular reference to a marine power steering system, it should be understood that the invention can be equally well incorporated into any other pressurized fluid-operated system having an open center neutral design, in order to block work ports so as to prevent them from being exposed to reservoir pressure when it is desired not to operate the system.

Various alternatives and embodiments are contemplated as being within the scope of the following claims particularly pointing out and distinctly claiming the subject matter regarded as the invention.

We claim:

1. In a marine power steering system including a pump for supplying pressurized fluid, and a cylinder assembly having an extendable and retractable rod interconnected with a pivotable marine drive unit for providing a steering assist thereto, the improvement comprising a control valve interposed between the pump and the cylinder assembly for controlling the supply of pressurized fluid to the cylinder assembly, comprising:

a housing including an internal wall defining an internal passage and having an inlet opening onto the internal wall in communication with the pump for supplying pressurized fluid to the internal passage, an outlet opening onto the internal wall for discharging fluid from the internal passage, and at least one work port opening onto the internal wall between the inlet and the outlet in communication with the internal passage for supplying pressurized fluid from the internal passage to the cylinder assembly; and a spool member mounted for movement within the internal passage, the spool member being movable between a neutral position and at least a first working position, wherein the spool member includes a blocking land for blocking the work port when the spool member is in its neutral position and recess structure independent of the internal wall for establishing communication between the housing inlet and the work port when the spool member is in its first working position and for establishing communication between the inlet and the outlet when the spool member is in its neutral position.

2. The improvement of claim 1, wherein the marine power steering system includes a fluid reservoir, and wherein the pump is interconnected with the reservoir for supplying pressurized fluid therefrom, and wherein the outlet is in communication with the reservoir for returning fluid thereto.

3. The improvement of claim 1, wherein the housing includes a pair of work ports, with a first one of the work ports being in communication with the cylinder assembly so as to provide extension of the rod and a second one of the work ports being in communication with the cylinder assembly so as to provide retraction of the rod, and wherein the spool member includes a pair of blocking lands for blocking the first and second work ports when the spool member is in its neutral position.

4. The improvement of claim 1, wherein the spool member recess structure includes a pair of annular recesses provided on the spool member, one of which is in communication with the inlet and the other of which is in communication with the outlet when the spool member is in its neutral position, and at least one channel provided on the spool member extending between the pair of annular recesses, and wherein the blocking land is disposed between and defined by the pair of annular recesses.

5. The improvement of claim 4, wherein the housing further includes a second outlet opening onto the internal wall in communication with the internal passage for discharging fluid therefrom, the second outlet being spaced from the first outlet, wherein the inlet is disposed between the first and second outlets, and further comprising a second work port opening onto the internal wall between the inlet and the second outlet, and wherein the spool member further includes second recess structure for establishing communication between the inlet and the second outlet when the spool member is in its neutral position, and blocking structure for blocking the second work port when the spool member is in its neutral position.

6. A control valve for a fluid-operated system which includes a source of pressurized fluid, comprising:

a housing including an internal wall defining an internal passage, and having an inlet opening onto the internal wall in communication with the internal passage for supplying pressurized fluid thereto from the pressurized fluid source, at least one outlet opening onto the internal wall for discharging fluid from the internal passage, and at least one work port opening onto the internal wall between the inlet and the outlet in communication with the internal passage for supplying pressurized fluid from the internal passage to the pressurized fluid-operated system; and a spool member mounted to the housing for sliding movement within the internal passage, the spool member being movable between a neutral position and at least a first working position, wherein the spool member includes recess structure independent of the internal wall for establishing communication between the housing inlet and the work port when the spool member is in its first working position, and for establishing communication between the inlet and the outlet when the spool member is in its neutral position, wherein the spool member further includes blocking structure for blocking the work port when the spool member is in its neutral position.

7. The control valve of claim 6, wherein the spool member recess structure includes a series of annular recesses, and wherein the housing includes a second outlet opening onto the internal wall in communication with the internal passage for discharging fluid therefrom, the second outlet being spaced from the first outlet, and further comprising a second work port disposed between the inlet and the second outlet opening onto the internal wall, wherein the spool member recesses are arranged so that, when the spool member is in its neutral position, a first one of the spool member recesses is in communication with the inlet, a second one of the spool member recesses is in communication with the first outlet, and a third one of the spool member recesses is in communication with the second outlet, and wherein the spool member blocking structure includes a pair of blocking lands for blocking the first and second work ports when the spool member is in its neutral position.

8. In a marine power steering system including a reservoir; a pump for providing pressurized fluid from the reservoir; a cylinder assembly having an extendible and retractable rod interconnected with a pivotable marine drive unit for providing a steering assist thereto; and a housing having an internal passage including a pair of work ports for supplying pressurized fluid from the pump to the cylinder assembly to control extension and retraction of the rod, an inlet for receiving pressurized fluid from the pump, and a pair of outlets in communication with the reservoir for returning fluid thereto; and a spool member disposed within the internal passage; a method of controlling the flow of fluid in the power steering system, comprising the steps of forming recess structure in the spool member to establish communication between the pump and one of the work ports when it is desired to extend or retract the rod and to provide return flow of fluid from the cylinder assembly to the reservoir when it is desired not to extend or retract the rod, independent of the housing, and blocking communication via the spool member between the fluid source and the work ports while establishing communication between the fluid source and the reservoir via the recess structure.

9. The method of claim 8, wherein the spool member recess structure includes a series of annular recesses defining a pair of blocking lands, and wherein the housing includes a second outlet in communication with the internal passage for discharging fluid therefrom, the second outlet being spaced from the first outlet and being defined by an annular recess formed in the internal passage, and further comprising a second work port disposed between the inlet and the second outlet, wherein the spool member recess structure is arranged so that, when the spool member is in its neutral position, a first one of the spool member recesses is in communication with the inlet, a second one of the spool member recesses is in communication with the first outlet, and a third one of the spool member recesses is in communication with the second outlet, and wherein the spool member blocking lands function to block the first and second work ports when the spool member is in its neutral position.

10. A method of controlling the flow of fluid in a selectively operable fluid-operated system which includes a reservoir; a source of pressurized fluid for providing pressurized fluid from the reservoir; and a housing having an internal passage including at least one work port for supplying pressurized fluid from the pressurized fluid source to the fluid-operated system, an inlet for receiving pressurized fluid from the fluid source, and a pair of outlets in communication with the reservoir for returning fluid thereto; and a spool member disposed within the internal passage; the method comprising the steps of establishing communication between the pressurized fluid source and the work port when it is desired to operate the fluid-operated system by forming recess structure in the spool member independent of the housing, and blocking communication via the spool member between the pressurized fluid source and the work port while establishing communication between the pressurized fluid source and the reservoir via the spool member recess structure, to provide return flow of fluid from the system to the reservoir when it is desired not to operate the fluid-operated system.

* * * * *